US006416340B2

(12) United States Patent
Schaefer et al.

(10) Patent No.: US 6,416,340 B2
(45) **Date of Patent: *Jul. 9, 2002**

(54) SINGLE BLADE TERMINAL POWER CONNECTOR SYSTEM

(76) Inventors: Christopher E. Schaefer, 1718 Southern Blvd., Warren, OH (US) 44485; John Kountz, 8751 Chesterton Dr., Poland, OH (US) 44514; Joseph A Finnerty, 1380 Bittersweet Dr., Warren, OH (US) 44484; Robert Stang, P.O. Box 431, Warren, OH (US) 44486

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/564,280

(22) Filed: May 4, 2000

(51) Int. Cl.[7] ..... H01R 27/00
(52) U.S. Cl. ..... 439/224
(58) Field of Search ..... 439/224, 845, 439/787, 909, 927, 909.1, 854, 843, 790

(56) References Cited

U.S. PATENT DOCUMENTS

| | | | | | |
|---|---|---|---|---|---|
| 2,471,923 | A | * | 5/1949 | Batcheller | 173/363 |
| 2,648,827 | A | * | 8/1953 | Knollman | 339/256 |
| 2,785,387 | A | * | 3/1957 | Batcheller | 339/258 |
| 5,433,630 | A | * | 7/1995 | Inaba et al. | 439/843 |
| 5,588,884 | A | | 12/1996 | Rudoy et al. | |
| 5,911,605 | A | * | 6/1999 | Wooldridge et al. | 439/790 |
| 6,125,588 | A | * | 10/2000 | Schultz | 49/375 |

* cited by examiner

*Primary Examiner*—Gary Paumen
*Assistant Examiner*—Phuong Chi Nguyen

(57) ABSTRACT

A power connector system has a male member, a female member and a contact member. A cable is attached to the male member. The female member has a U-shaped channel. The contact member is U-shaped and is received in the channel. The side walls of the channel have outer edges defining an outer opening to the channel and end edges defining an end opening to the channel. The male member has a single blade which is insertable into the contact member either though the outer opening or through the end opening.

8 Claims, 2 Drawing Sheets

SINGLE BLADE TERMINAL POWER CONNECTOR SYSTEM

This invention relates generally to electrical power connectors, and more particularly to a terminal system for power connectors of the type used in automotive vehicle batteries, power electronics, alternators, electric motors and the like.

BACKGROUND OF THE INVENTION

High power terminals can be made by stamping or on a screw machine. Present stamped terminals are expensive and difficult to manufacture. What is needed is a terminal system which lends itself to normal processing methods, can be made at a lower cost, and permits more convenient mating of the terminal parts with one another.

SUMMARY OF THE INVENTION

The terminal connection system of this invention overcomes the shortcomings of previous systems. It is cost competitive with ring terminals and eliminates the need for bolt-on fasteners. The system includes a single blade male contact which is relatively easy to manufacture. The connection system of this invention is fully stampable in a progressive die, can be readily installed in a particular application, and is easy to inspect and to service. The single blade connector system of this invention can replace ring terminals for a multitude of applications where "toolless" assembly is required. The single blade design allows for smaller packaging. The single blade design also permits the blade to be inserted into the female counterpart from various directions allowing for more cable options due to the design of the contact spring element.

It accordance with the present invention, the female connector part is in the form of a U-shaped channel for receiving the contact spring element. The contact spring element is itself U-shaped enabling the single blade to be inserted from more than one direction, greatly facilitating assembly.

One object of this invention is to provide a terminal system for power connectors having the foregoing features and capabilities.

Another object is to provide a terminal system composed of a relatively few simple parts, which are rugged and durable in use, and capable of being easily manufactured and assembled.

These and other objects, features and advantages of the invention will become more apparent as the following description proceeds, especially when considered with the accompanying drawings.

DETAILED DESCRIPTION OF THE PREFERRED EMBODIMENTS

Figure 1:
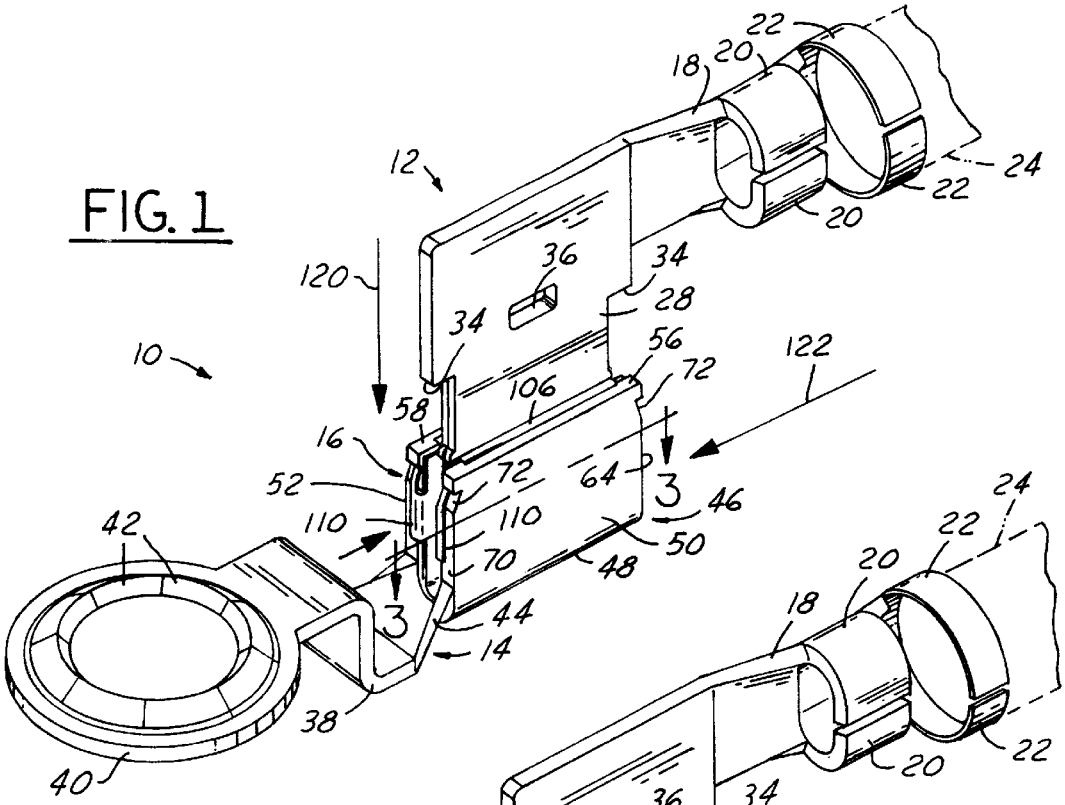
FIG. 1 is a perspective view of a terminal connector system constructed in accordance with the invention.
Figure 2:
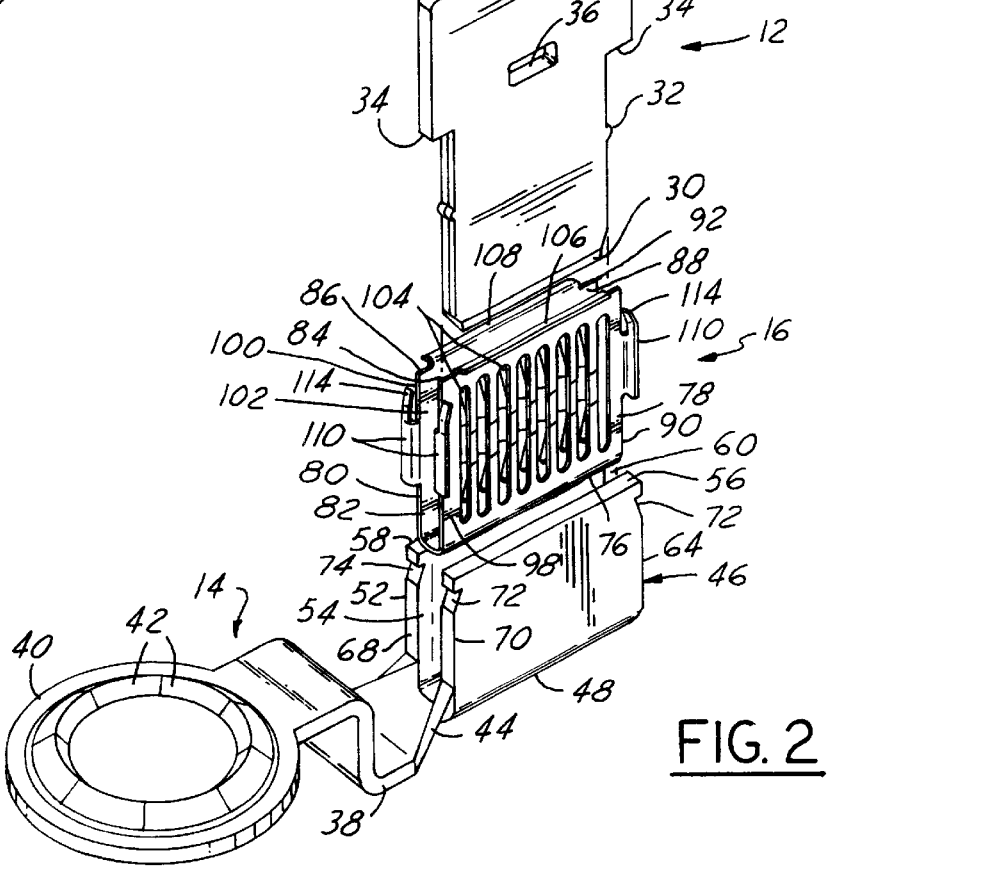
FIG. 2 is an exploded view of the terminal connector system shown in FIG. 1.
Figure 3:
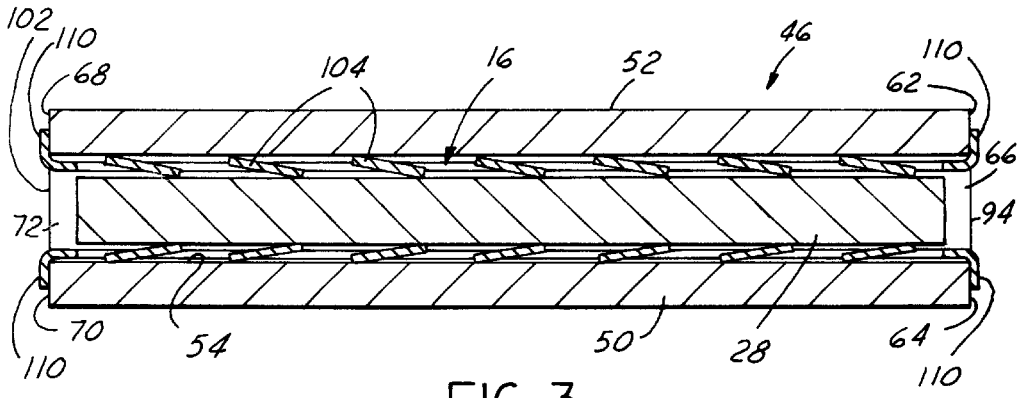
FIG. 3 is a sectional view taken on the line 3—3 in FIG. 1.

Referring now more particularly to the drawings, the power terminal connector system 10 of this invention includes a male member 12, a female member 14 and a spring contact member 16.

The male member 12 is preferably an electrically conductive metal stamping and has an elongated bar 18 formed adjacent one end with a pair of laterally spaced fingers 20 and a second pair of laterally spaced fingers 22 which are bent over an end of a cable 24 to secure the cable to the bar. The male member 12 has an integral, single blade 28 at the opposite end of the bar 18 which in FIG. 1 extends perpendicular to the bar. The blade is an elongated, thin, flat plate-like member which is beveled at the free end 30 to facilitate its entry into the contact member 16 as described more fully hereinafter.

The blade preferably has laterally outwardly projecting nibs 32 along opposite side edges to position a seal when needed or desired, and laterally spaced apart shoulders 34 to form abutments limiting the insertion of the blade into a connector housing (not shown). The blade also has a slot 36 which may receive a latch (not shown) to retain the blade in the connector housing.

The female member 14 is preferably an electrically conductive metal stamping and has an elongated bar 38 formed adjacent one end with an integral ring 40 having radially inwardly extending flexible tabs 42 defining an opening for receiving a battery post, for example. The opposite end portion 44 of the female member 14 is formed to provide an integral, elongated U-shaped channel 46. The channel 46 includes a base 48 which extends generally in straight line continuation of the end portion 44 of the bar 38, and laterally spaced apart rectangular parallel side walls 50 and 52 extending perpendicular to the base. The base and side walls form a rectangular recess 54 within the channel. The side walls 50 and 52 have outer edges 56 and 58 which are parallel to the base 48 and define an outer opening 60 to the recess 54. The side walls have end edges 62 and 64 at one end of the channel forming an end opening 66 to the recess 54. End edges 68 and 70 at the opposite end of the channel form a second end opening 72 to the recess 54. The end edges 62, 64, 68 and 70 have notches 72 and 74 for releasably retaining the contact member 16 as more filly described hereinafter.

The contact member 16 is preferably an electrically conductive, U-shaped metal stamping having a base 76, and laterally spaced apart, rectangular, parallel side walls 78 and 80 extending perpendicular to the base. The base and side walls of the contact member 16 form a recess 82. The side walls 78 and 80 have outer edges 84 and 86 which are parallel to the base 76 and define an outer opening 88 to the recess 82. The side walls 78 and 80 have end edges 90 and 92 at one end forming an end opening 94 to the recess 82. End edges 98 and 100 at the opposite end form a second end opening 102 to the recess. Each of the side walls 78 and 80 of the contact member 16 is slotted at spaced points to form flexible webs 104 which are twisted as shown to extend transversely of the plane of the side wall for contact with the side walls 50 and 52 of the channel 46 of the female member.

Along the outer edges of the two side walls 78 and 80 of the contact member 16 are laterally outwardly extending flanges 106 and 108. Along each end edge of each of the side walls 78 and 80 of the contact member 16 is a laterally outwardly extending flange 110 having at the outer end thereof an inwardly inclined tab 114.

The contact member 16 has a transverse dimension generally similar to the width of the recess 54 in the channel 46 so that the contact member may be inserted into the recess with the base 76 of the contact member contacting the base 48 of the channel 46 and the webs 104 of the side walls 78 and 80 of the contact member in electrical contact with the side walls 50 and 52 of the channel. The contact member when fully inserted causes the flanges 106 and 108 along the outer edges of the side walls 78 and 80 of the contact member to engage the outer edges 56 and 58 of the side walls of the channel, and the flanges 110 along the end edges of the side walls 78 and 80 of the contact member to engage the end edges 62 and 64 of the side walls of the channel 46, with the tabs 114 engaging in the notches 72 and 74 of the side walls of the channel locating and releasably locking the contact member within the recess 54 of the channel.

When the contact member 16 is fully inserted into the recess 54 in the channel 46 of the female member 14, the outer opening 88 to the recess 82 of the contact member registers with the outer opening 60 of the channel 46, the end opening 94 of the recess 82 registers with the end opening 66 of the channel, and the end opening 102 of the recess 82 registers with the end opening 72 of the channel.

Figure 4:
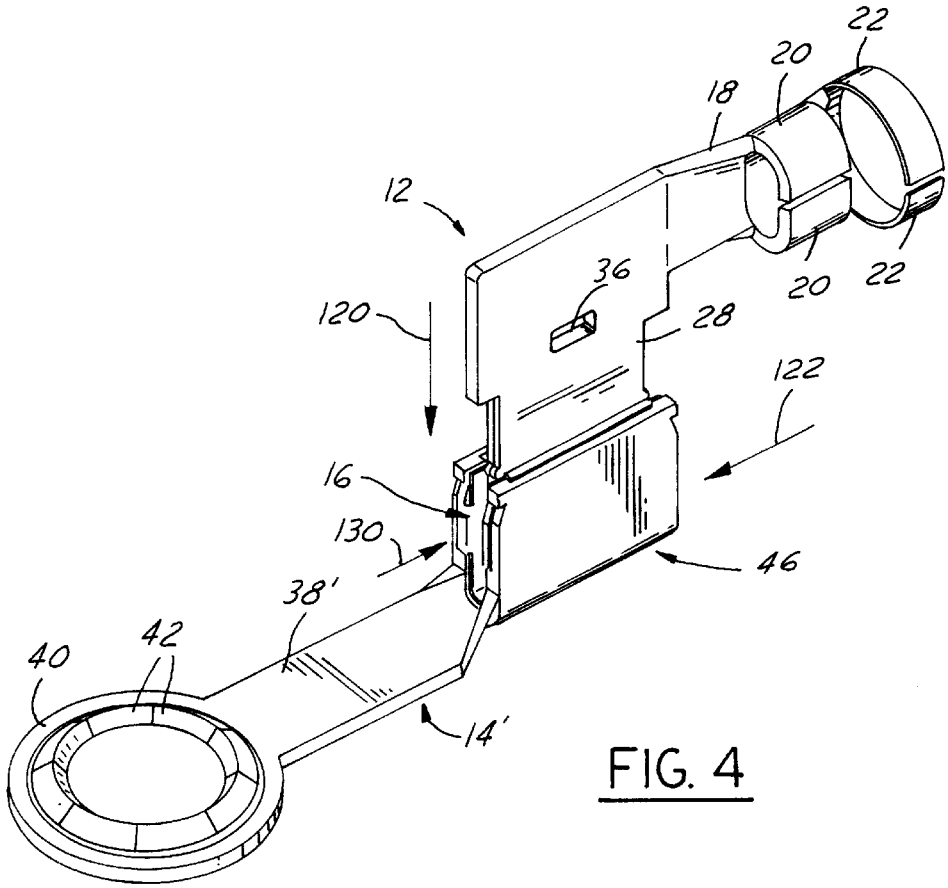
FIG. 4 is a perspective view showing a modification.

The blade 28 of the male member 12 is insertable into the recess 82 of the contact member 16, as will be apparent in FIG. 1, in a direction perpendicular to the base 76 of the contact member as indicated by the arrow 120 through the registering openings 60 and 88 of the channel and the contact member, or in a direction perpendicular to the direction 120 as indicated by the arrow 122 though the registering openings 66 and 94 between the side edges of the channel and the contact member. It will be understood that if the bar 38' of the female member 14' is substantially straight as indicated in FIG. 4 rather than bent as shown in FIG. 1, the blade may also be inserted through the registering openings 72 and 102 in the opposite end of the channel and contact member as indicated by the arrow 130 which is generally aligned with the direction of insertion indicated by the arrow 122 but in the opposite direction. The blade, when fully inserted in the contact member 16, is in electrical contact with the webs 104 of the contact member. Except for the substantially straight bar 38' of the female member 14', the construction in FIG. 4 is the same as in FIG. 1.

What is claimed is:

1. A power connector system comprising:

a male member, a female member and a contact member, said male member having a single blade, said female member having a generally U-shaped channel, said U-shaped channel being defined by a base and laterally spaced apart side walls extending outwardly from said base to form a first recess for receiving said contact member, said side walls having outer edges spaced from said base defining a first outer opening to said first recess, said side walls having end edges at one end of said channel defining a first end opening to said first recess, said contact member being of unitary, one-piece construction and generally U-shaped having a base and laterally spaced apart side walls extending outwardly from said base to form a second recess for receiving said blade, said contact member being disposed in the first recess of said channel with the base of said contact member adjacent to the base of said channel and with the side walls of said contact member in contact with the respective side walls of said channel, the side walls of said contact member having outer edges defining a second outer opening to said second recess registering with said first outer opening, the side walls of said contact member having end edges at one end of said contact member defining a second end opening to said second recess registering with said first end opening, said single blade being insertable into the second recess in said contact member in contact with the side walls thereof in a first direction through the registering outer openings or in a second direction through the registering end openings, wherein the side walls of said channel have end edges at the opposite end of said channel defining a third end opening to said first recess, the side walls of said contact member have end edges at the opposite end of said contact member defining a third end opening to said second recess registering with said third end opening to said first recess, and said single blade is insertable into the second recess in said contact member in a third direction through the third registering openings, and wherein the outer edges of the side walls of the contact member have laterally outwardly extending first flanges engaging over the outer edges of the side walls of the channel, and the end edges of the side walls of the contact member have laterally outwardly extending second flanges provided with tabs releasably engaged in notches in the end edges of the side walls of the channel to releasably lock the contact member in the recess of the channel.

2. A power connector system comprising, a male member, a female member and a contact member, said male member having a single blade, said female member having a generally U-shaped channel, said U-shaped channel being defined by a base and laterally spaced apart side walls extending outwardly from said base to form a first recess for receiving said contact member, said side walls having outer edges spaced from said base defining a first outer opening to said first recess, said side walls having end edges at one end of said channel defining a first end opening to said first recess, said contact member being of unitary, one-piece construction and generally U-shaped having a base and laterally spaced apart side walls extending outwardly from said base to form a second recess for receiving said blade, said contact member being disposed in the first recess of said channel with the base of said contact member adjacent to the base of said channel and with the side walls of said contact member in contact with the respective side walls of said channel, the side walls of said contact member having outer edges defining a second outer opening to said second recess registering with said first outer opening, the second outer opening disposed laterally inwardly to the first outer opening, the side walls of said contact member having end edges at one end of said contact member defining a second end opening to said second recess registering with said first end opening, said single blade being insertable into the second recess in said contact member in contact with the side walls thereof in a first direction through the registering outer openings or in a second direction through the registering end openings.

3. A power connector system as defined in claim 2, wherein the side walls of said channel have end edges at the opposite end of said channel defining a third end opening to said first recess, the side walls of said contact member have end edges at the opposite end of said contact member defining a third end opening to said second recess registering with said third end. opening to said first recess, and said single blade is insertable into the second recess in said contact member in a third direction through the third registering openings.

4. The power connector system set forth in claim 2 wherein the end edges of the side walls of the contact member have laterally outwardly extending second flanges provided with tabs engaged releasably in notches in the end edges of the side walls of the channel to releasably lock the contact member in the recess of the channel.

5. A power connector as defined in claim 2, wherein the side walls of said channel are parallel and the side walls of said contact member are parallel to the respective side walls of said channel, and the first and second directions are perpendicular to one another.

6. A power connector system as defined in claim 3, wherein the side walls of said channel are parallel and the side walls of said contact member are parallel to the respective side walls of said channel, and said second direction is aligned with and opposite to said third direction and said first direction is perpendicular to said second and third directions.

7. The power connector system set forth in claim 2 wherein the outer edges of the side walls of the contact member have laterally extending first flanges engaging over the outer edges of the side walls of the channel.

8. The power connector system set forth in claim 7 wherein the end edges of the side walls of the contact member have laterally outwardly extending second flanges provided with tabs engaged releasably in notches in the end edges of the side walls of the channel to releasably lock the contact member in the recess of the channel.

* * * * *